US010544628B2

(12) United States Patent
Omidvar

(10) Patent No.: US 10,544,628 B2
(45) Date of Patent: Jan. 28, 2020

(54) DRILL BIT WITH SELF-DIRECTING NOZZLE AND METHOD OF USING SAME

(71) Applicant: NATIONAL OILWELL DHT, L.P., Houston, TX (US)

(72) Inventor: Navid Omidvar, The Woodlands, TX (US)

(73) Assignee: National Oilwell DHT, L.P., Conroe, TX (US)

( * ) Notice: Subject to any disclaimer, the term of this patent is extended or adjusted under 35 U.S.C. 154(b) by 170 days.

(21) Appl. No.: 15/561,917

(22) PCT Filed: Mar. 30, 2016

(86) PCT No.: PCT/US2016/025084

§ 371 (c)(1),
(2) Date: Sep. 26, 2017

(87) PCT Pub. No.: WO2016/161028

PCT Pub. Date: Oct. 6, 2016

(65) Prior Publication Data

US 2018/0112469 A1 Apr. 26, 2018

Related U.S. Application Data

(60) Provisional application No. 62/141,811, filed on Apr. 1, 2015.

(51) Int. Cl.
*E21B 10/61* (2006.01)
*E21B 10/60* (2006.01)
(Continued)

(52) U.S. Cl.
CPC ..... *E21B 10/61* (2013.01); *B05B 3/06* (2013.01); *E21B 10/18* (2013.01); *E21B 10/38* (2013.01);
(Continued)

(58) Field of Classification Search
CPC ..... E21B 10/61; E21B 10/602; E21B 10/38; E21B 10/18; E21B 2010/607; B05B 3/06
See application file for complete search history.

(56) References Cited

U.S. PATENT DOCUMENTS 4,221,336 A * 9/1980 Diamond ..... A61H 33/027 239/428.5
4,668,018 A * 5/1987 Demoulin ..... E21C 35/23 299/17
(Continued)

FOREIGN PATENT DOCUMENTS

RU 2215114 C1 10/2003
SU 1781410 A1 12/1992

OTHER PUBLICATIONS

International Patent Application No. PCT/US2016/025084 International Search Report and Written Opinion dated Jun. 24, 2016 (8 pages).
(Continued)

*Primary Examiner* — Michael R Wills, III
(74) *Attorney, Agent, or Firm* — Conley Rose, P.C.

(57) ABSTRACT

A self-directing nozzle of a drill bit of a downhole tool and method are disclosed. The drill bit with the nozzle may be used to form a wellbore in a subterranean formation. The drill bit has a passage for fluid to pass through. The nozzle includes a case positionable in the passage of the drill bit and a movable body movably positionable in the case. The movable body has a channel for passage of the fluid therethrough. The channel has a non-linear shape with a channel axis extending therethrough. The channel axis is curved to define a spiral flow path therethrough whereby the fluid passing through the channel facilitates rotation of the movable body within the passage of the drill bit.

25 Claims, 22 Drawing Sheets

(51) Int. Cl.
*E21B 10/18* (2006.01)
*B05B 3/06* (2006.01)
*E21B 10/38* (2006.01)

(52) U.S. Cl.
CPC ..... *E21B 10/602* (2013.01); *E21B 2010/607* (2013.01)

(56) References Cited

U.S. PATENT DOCUMENTS 4,687,066 A * 8/1987 Evans ..... E21B 10/18 166/222
4,739,845 A 4/1988 Dennis
4,776,412 A 10/1988 Thompson
4,794,995 A 1/1989 Matson et al.
5,330,016 A 7/1994 Paske et al.
5,562,171 A 10/1996 Besson et al.
5,732,783 A 3/1998 Truax et al.
5,967,244 A * 10/1999 Arfele ..... E21B 10/61 175/340
6,227,316 B1 5/2001 Rohde
6,390,211 B1 * 5/2002 Tibbitts ..... E21B 10/61 175/340
6,450,271 B1 9/2002 Tibbitts et al.
8,047,308 B2 11/2011 Gutmark et al.
8,141,664 B2 3/2012 Zahradnik et al.
8,733,475 B2 5/2014 Vo et al.
2011/0167734 A1 7/2011 Jiang et al.
2011/0174548 A1 7/2011 Patel et al.
2012/0205162 A1 8/2012 Patel et al.
2013/0233620 A1 9/2013 Rankin
2014/0102809 A1 4/2014 King et al.

OTHER PUBLICATIONS

Russian Patent Application No. 2017136106/03 Office Action dated May 8, 2019 (15 pages).

* cited by examiner

DRILL BIT WITH SELF-DIRECTING NOZZLE AND METHOD OF USING SAME

CROSS-REFERENCE TO RELATED APPLICATIONS

This application is a 35 U.S.C. § 371 national stage entry of PCT/US2016/025084, filed Mar. 30, 2016, which claims the benefit of U.S. Provisional Application No. 62/141,811, filed on Apr. 1, 2015, both of which are incorporated herein by reference in their entireties for all purposes.

STATEMENT REGARDING FEDERALLY SPONSORED RESEARCH OR DEVELOPMENT

Not applicable.

BACKGROUND

The present disclosure relates generally to techniques for performing well site operations. More specifically, the present disclosure relates to techniques, such as drill bits and/or nozzles, for drilling well bores.

Various oilfield operations may be performed to locate and gather valuable downhole fluids. Oil rigs are positioned at well sites and downhole tools, such as drilling tools, are deployed into the ground to reach subsurface reservoirs. The drilling tool may include a drill string with a bottom hole assembly, and a drill bit advanced into the earth to form a wellbore.

The drill bit may be connected to a downhole end of the bottom hole assembly and driven by drill-string rotation from surface and/or by mud flowing through the drilling tool. Examples of drill bits are disclosed in U.S. Pat. Nos. 5,330,016, 5,562,171, 5,732,783, 6,450,271, 8,141,664, 8,733,475, 2011/0167734, 2011/0174548, 2012/0205162, and 2014/0102809, the entire contents of which are hereby incorporated by reference herein.

During drilling, the drill bit engages the formation and cuts portions of the formation along the wellbore. The portions of the formation that are cut during drilling are referred to as 'cuttings.' Mud is passed through the drilling tool and out the drill bit to facilitate removal of the cuttings. The cuttings are removed from the wellbore by pumping the cuttings to the surface along an annulus between the downhole tool and the wellbore.

SUMMARY OF DISCLOSURE

In at least one aspect, the disclosure relates to a self-directing nozzle of a drill bit of a downhole tool for forming a wellbore in a subterranean formation. The drill bit has a passage for fluid to pass through. The nozzle includes a cage positionable in the passage of the drill bit and a movable body movably positionable in the cage. The movable body has a channel for passage of the fluid therethrough. The channel has a non-linear shape with a channel axis extending therethrough, and is curved to define a spiral flow path therethrough whereby the fluid passing through the channel facilitates rotation of the movable body within the passage of the drill bit.

The nozzle of claim 1, may also include a bearing positioned between the movable body and the cage, a seal positionable between the movable body and the cage, and/or at least one ring. The ring may include a bearing and/or a plate. An outer surface of the movable body and an inner surface of the cage may have grooves extending therein. The cage may have threads engageable with threads of the drill bit. The cage may have an outer surface engageable with an inner surface of the passage of the drill bit defining a press fit therebetween. The cage may have teeth extending from an end thereof.

The channel may have a funnel shaped inlet. At least a portion of the channel may be helical and/or have a circular outlet. The channel axis may be axially offset from a nozzle axis of the nozzle. The may have one of a constant and a variable curved radius along a length thereof.

In another aspect, the disclosure relates to a drill bit of a downhole tool for forming a wellbore in a subterranean formation. The drill bit includes a body having a passage for fluid to pass through, a shank extending from the body and connectable to a drill string of a downhole tool, and a self-directing nozzle. The self-directing nozzle may include a cage positionable in the passage of the drill bit and a movable body movably positionable in the cage. The movable body has a channel for passage of the fluid therethrough and a non-linear shape with a channel axis extending therethrough. The channel may be curved to define a spiral flow path therethrough whereby the fluid passing through the channel facilitates rotation of the movable body within the passage of the drill bit.

The passage may have a cavity portion extending through the shank and into the body, and an outlet portion extending through a wall of the body. The body may be a roller cone or a matrix bit. A plurality of the self-directing nozzles may be positioned in channels of the bit body.

Finally, in another aspect, the disclosure relates to a method of drilling a wellbore in a subterranean formation. The method involves providing a drill bit with a self-directing nozzle. The self-directing nozzle includes a cage positionable in the passage of the drill bit and a movable body movably positionable in the cage. The movable body has a channel for passage of fluid therethrough. The channel has a non-linear shape with a channel axis extending therethrough, and is curved to define a spiral flow path therethrough. The method further involves advancing the drill bit into the subterranean formation, and passing the fluid through the drill bit and through the non-linear channel such that the fluid spirals through the non-linear channel and rotates the movable body within the passage of the drill bit to emit a movable stream of the fluid about the drill bit.

The passing may involve passing the fluid spirally through the channel, generating turbulent fluctuation of the fluid against a surface of the wellbore, and/or generating a pressure differential about a surface area of the well bore, the surface area having a negative pressure area and a positive pressure area. The passing may also involve generating transient pressure levels lower than hydrostatic pressure of the wellbore by generating turbulent pressure fluctuations in the negative pressure area on a surface of the wellbore, and/or directing a tangential fluid force of the fluid against an exterior surface of the channel.

BRIEF DESCRIPTION OF THE DRAWINGS

Embodiments of devices and methods for use with downhole tools are described with reference to the following figures. Like numbers are used throughout the figures to reference like features and components. It is to be noted, however, that the figures are not to be considered limiting of with regard to the scope of the invention. The figures are not necessarily to scale and certain features and certain views of the figures may be shown exaggerated in scale or in schematic in the interest of clarity and conciseness.

DETAILED DESCRIPTION OF DISCLOSED EXEMPLARY EMBODIMENTS

In the following description, numerous details are set forth to provide an understanding of the present disclosure. However, it will be understood by those skilled in the art that the present disclosure may be practiced without these details and that numerous variations or modifications from the described embodiments are possible.

The disclosure relates to a drill bit with self-directing nozzles for passing fluid therethrough. The drill bit may be a matrix, roller cone, rotary, or other drill bit deployable by a drill string for drilling wellbores. The drill bit may have conventional nozzles that provide a stationary stream of the fluid and/or the self-directing nozzles to provide a movable (or directable) stream of the fluid therethrough. The self-directing nozzle may include a cage and a movable (e.g., rotatable) body having a non-linear (e.g., helical and/or spiral) fluid channel therethrough, and bearings (e.g., retention, thrust, journal, etc.) As fluid passes through the self-directing nozzles, the nozzle moves to direct flow in various directions about the wellbore.

The self-directing nozzle may be used to move flow of the fluid along a surface of the wellbore to clean the wellbore and/or the drill bit, and/or to remove cuttings. This movement may also be used, for example, in an attempt to increase turbulent flow about a bottom of the wellbore during drilling, to facilitate removal of cuttings (and/or debris) about portions (hard and/or soft) of the wellbore, to selectively vary a flow rate of the fluid, to fluctuate turbulent flow about the drill bit, to increase a surface area for fluid flow about a bottom of the wellbore, to increase dimension (e.g., radius) of turbulent fluctuation about the drill bit, to vary fluid pressure about the drill bit, to increase rate of penetration (ROP), to create a pressure differential about the wellbore, among others.

Figure 1:
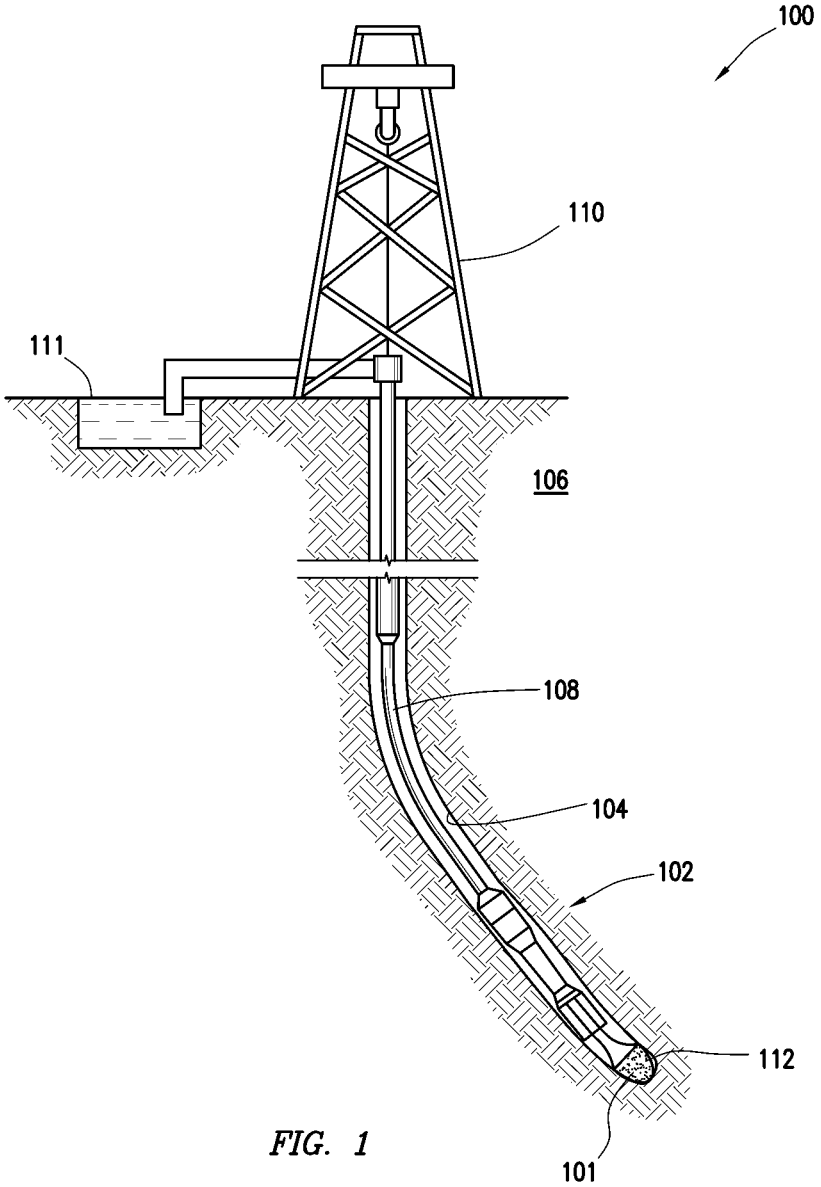
FIG. 1 is a schematic diagram of a well site including a rig with a downhole tool having a drill bit advanced into the earth to form a wellbore, the drill bit having a self-directing nozzle.

FIG. 1 schematically depicts a well site 100 in which the drill bits with self-directing nozzles described herein may be used. As generally shown, the drill bit 112 may be advanced into a subterranean formation 106 at a downhole end of a downhole tool 102 to form a wellbore (or borehole) 104. The downhole tool 102 may be driven by any suitable means, such as by a rotary drill string 108 operated from a drilling rig 110 to rotate the drill bit 112.

A mud pit 111 is provided at the well site 100 to pass drilling fluid through the downhole tool 102 and out the drill bit 112 to cool the drill bit 112 and carry away cuttings during drilling. Fluid pumped from the mud pit 111 through the downhole tool 102 is released through the drill bit 112 into the wellbore 104 and returned to a surface for recirculation via an annulus between the downhole tool 102 and a wall of the wellbore 104.

The drill bit 112 is provided with at least one self-directing nozzle 101 for passing fluid from the downhole tool 102 out the drill bit 112 and into the wellbore 104. The self-directing nozzle 101 may be used to movably direct fluid flow out of the drill bit 112 about portions of the wellbore 104.

While a specific configuration of a well site 100 is depicted, it will be appreciated that the well site may be land-based or offshore, and have various well site components, such as telemetry, measurement, communication, power, and/or other devices. The downhole tool 102 may advance the drill bit 112 in various directions to penetrate one or more environs of interest, and to form a wellbore of various configurations (e.g., vertical, deviated, horizontal, etc.) Any downhole tool 102 and/or drill bit 112 may be utilized in conjunction with the self-directing nozzle to form the wellbore 104.

Also, while the self-directing nozzle 101 described herein is depicted in a drill bit 112, it may be used in any portion of the downhole tool and/or drill bit. For brevity, only a few example of self-directing nozzles and drill bits are depicted herein. Such drill bits may be utilized in conjunction with any downhole tool to form a wellbore.

Exemplary Drill Bit Structures

Figure 2:
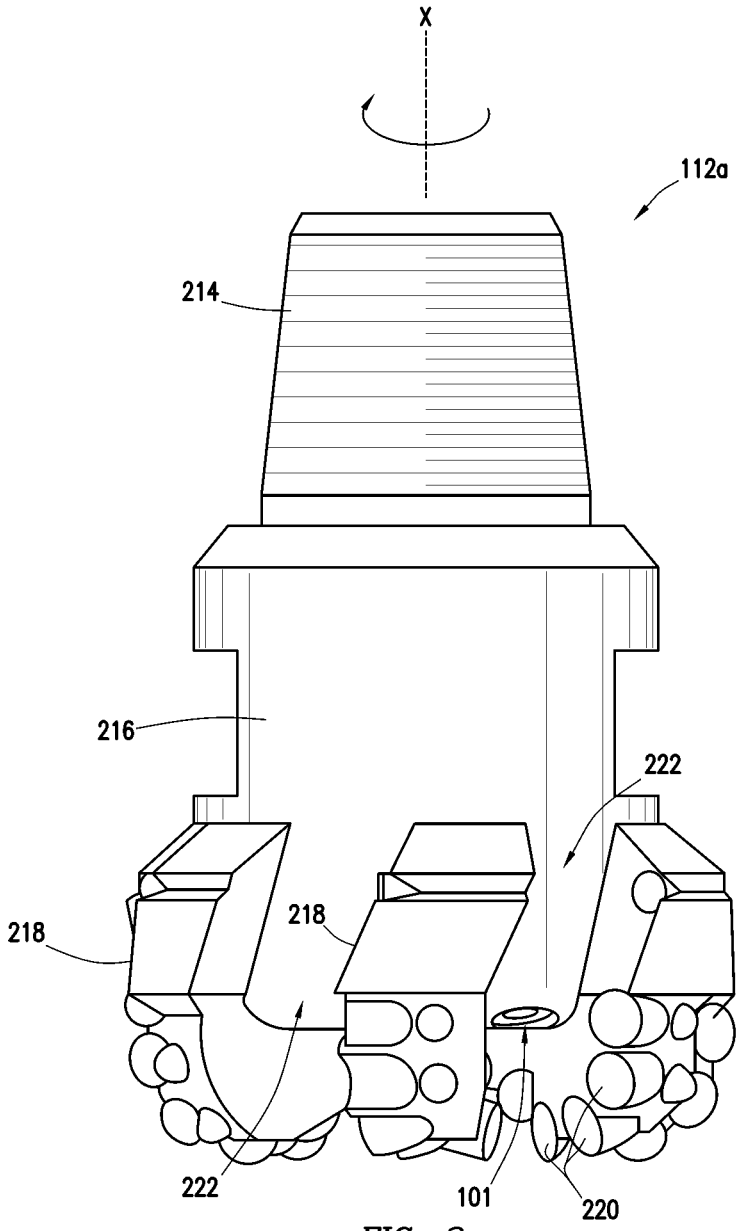
FIG. 2 is a side view of an example matrix drill bit with the self-directing nozzle.
Figure 3:
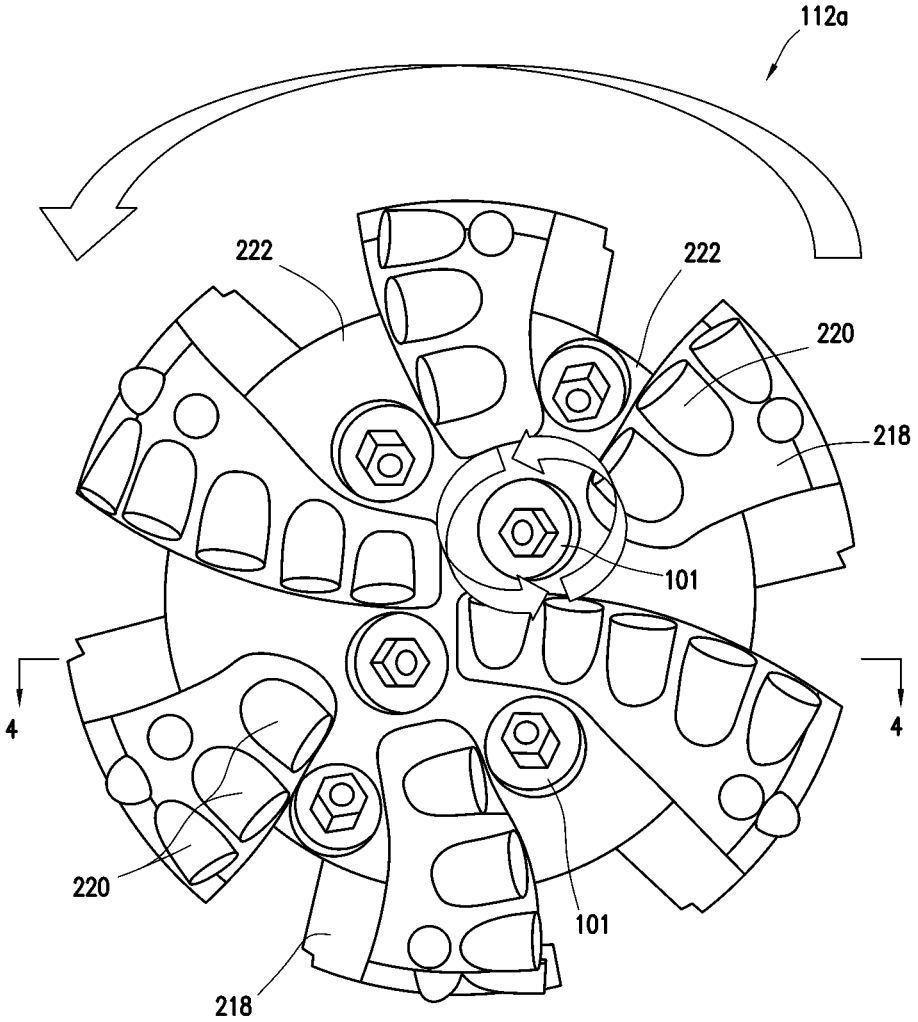
FIG. 3 is an end view of the drill bit of FIG. 2.
Figure 4:
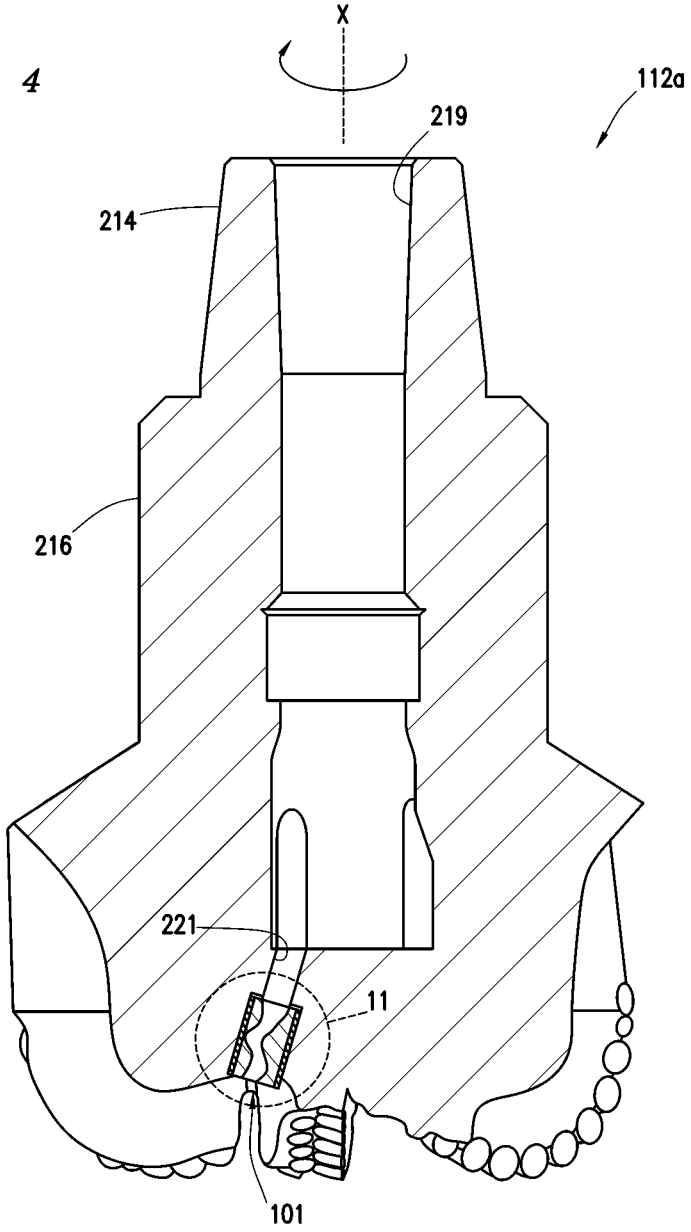
FIG. 4 is a longitudinal, cross-sectional view of the drill bit of FIG. 3 taken along line 4-4.
Figure 5:
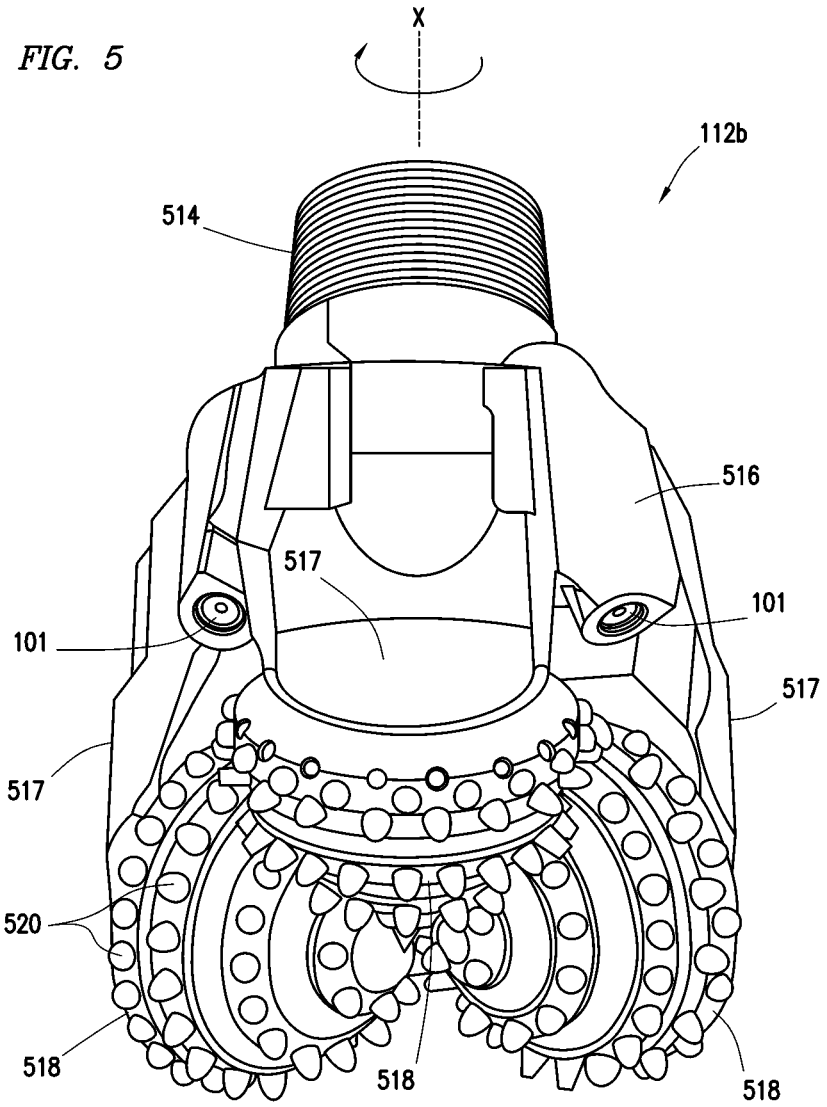
FIG. 5 is a perspective view of an example roller cone drill bit with the self-directing nozzle.
Figure 6:
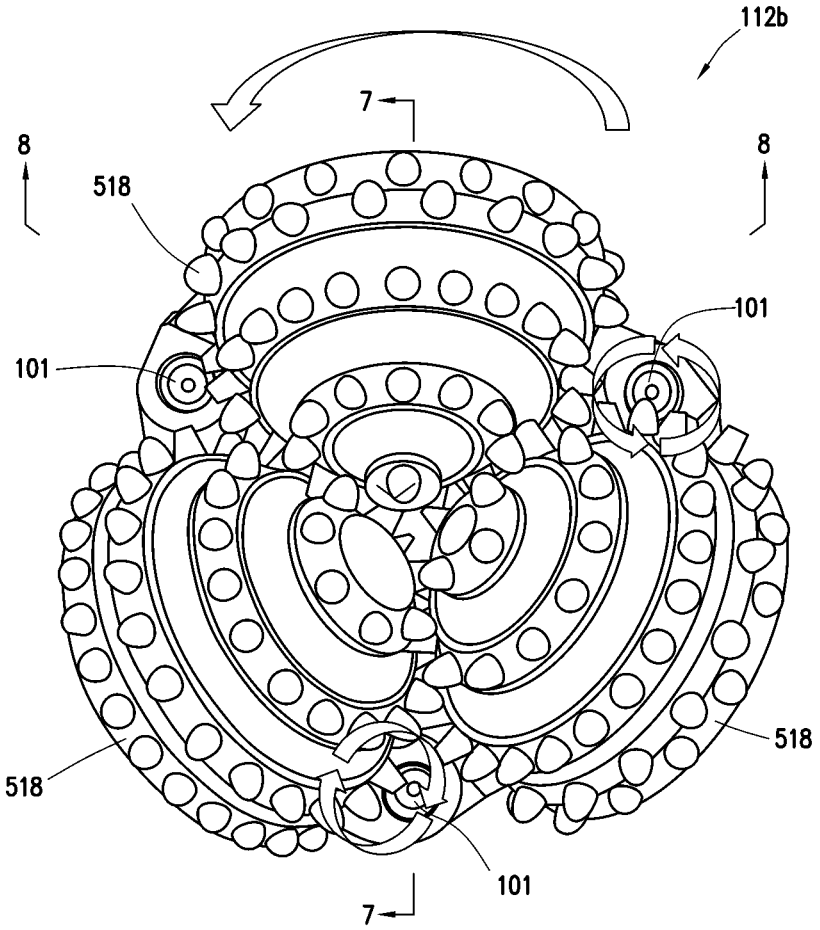
FIG. 6 is an end view of the drill bit of FIG. 5.
Figure 7:
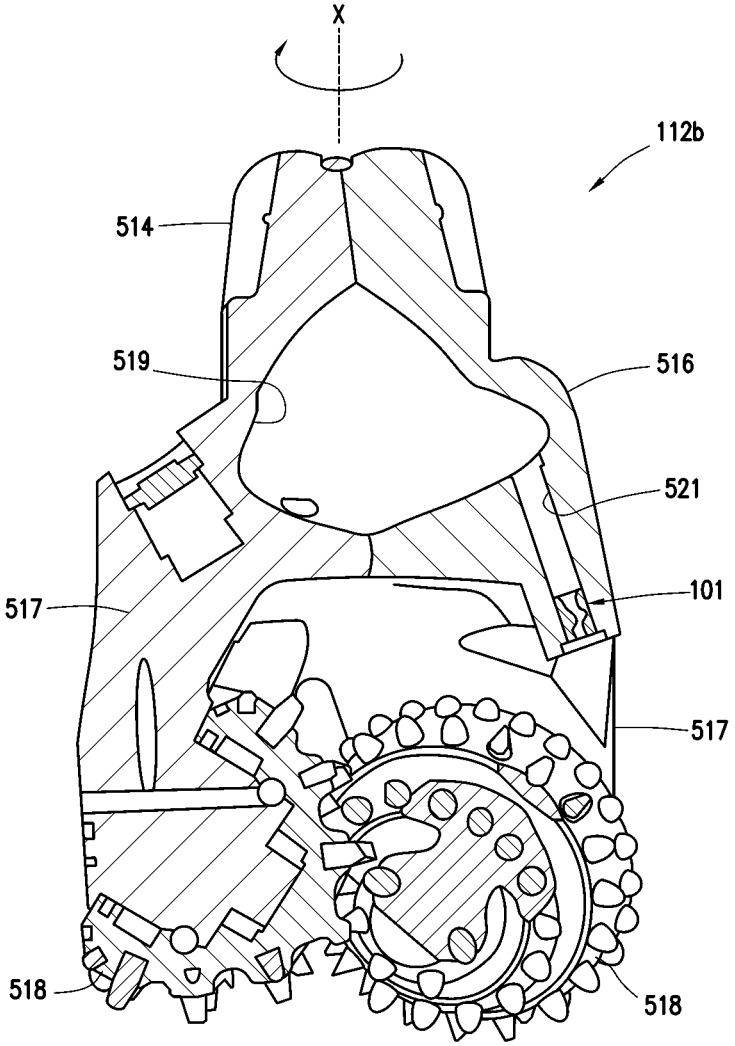
FIG. 7 is a longitudinal cross-sectional view of the drill bit of FIG. 6 taken along line 7-7.
Figure 8:
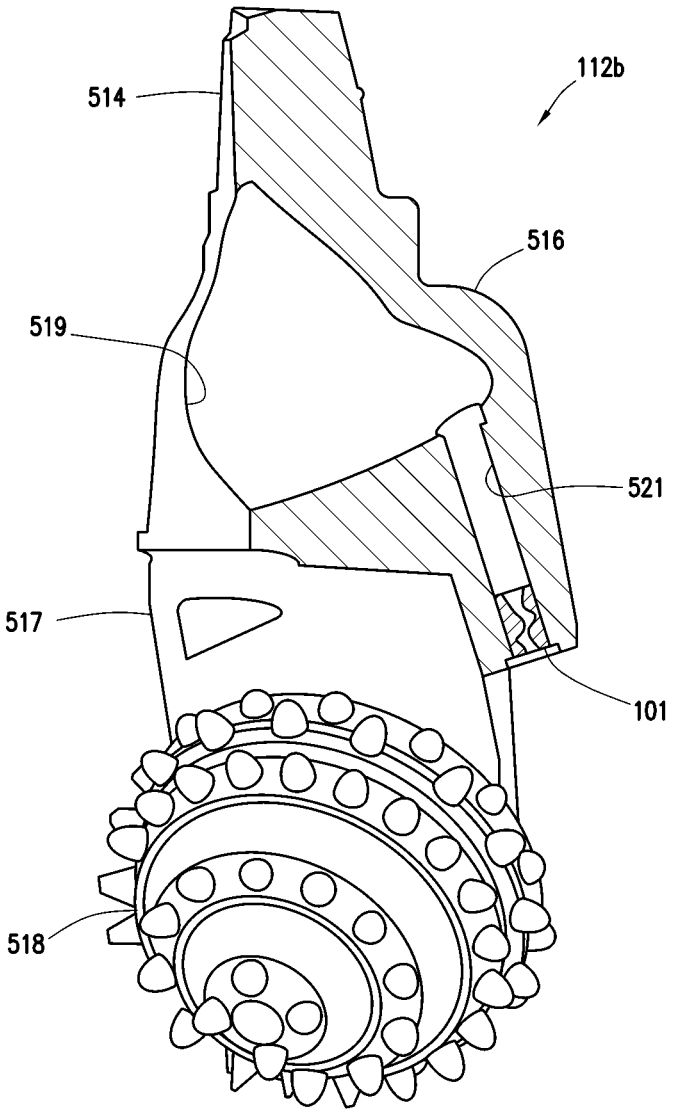
FIG. 8 is a sectional view of the drill bit of FIG. 6 taken along line 8-8.
Figure 9:
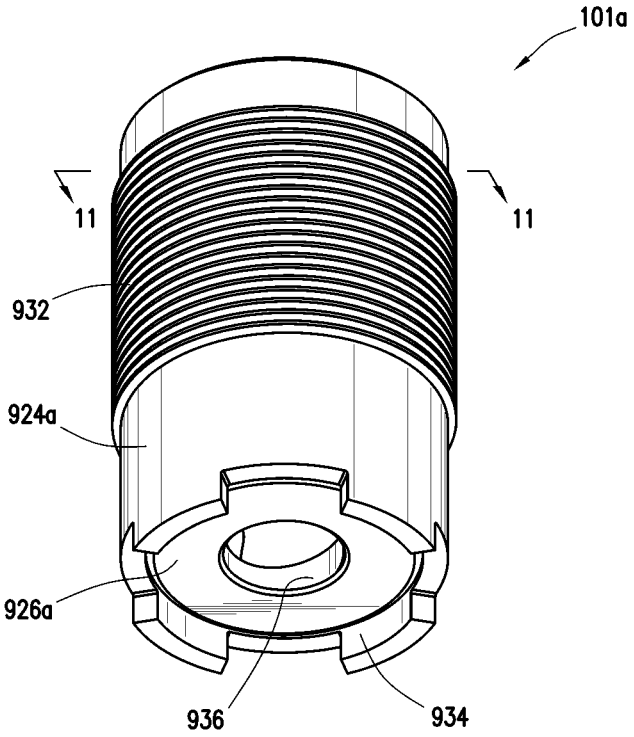
FIG. 9 is a perspective view of a self-directing nozzle in a retention bearing configuration with threads.
Figure 10:
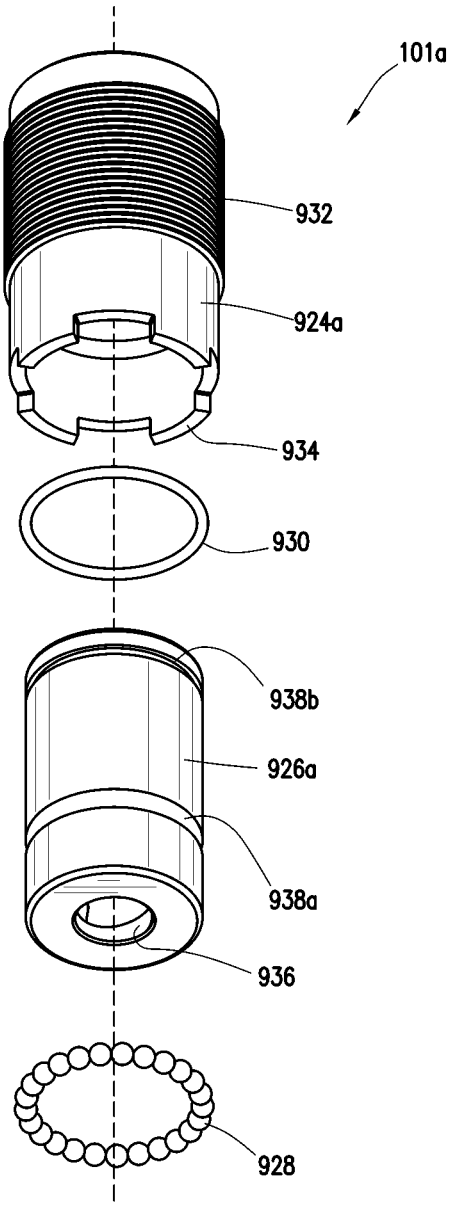
FIG. 10 is an exploded view of the self-directing nozzle of FIG. 9.

FIGS. 2-8 depict various views of example drill bits 112*a,b* provided with self-directing nozzles 101 usable as the drill 112 and nozzle 101 of FIG. 1. FIGS. 2-4 depict an example matrix drill bit 112*a*. FIGS. 5-8 depict an example roller cone drill bit 112*b*. The self-directing nozzles 101 are positioned in the drill bits 112*a,b* to direct fluid flow therethrough.

As shown in FIGS. 2-4, the drill bit 112*a* is a matrix drill bit including a shank 214, a bit body 216, blades (or ribs) 218, cutting elements 220, and self-directing nozzles 101. The drill bit 112*a* (and/or portions thereof) may be made of any suitable material, such as tungsten carbide. The shank 214 is connectable to the downhole tool (see 102 of FIG. 1) and drivable thereby about an axis X as indicated by the curved arrows. The shank 214 may be provided with threads or other means for connection to the downhole tool.

The bit body 216 is supported by the shank 214 and has the blades 218 extending therefrom. The blades 218 extend along a downhole end and radially about the bit body 216 for engagement with the wall of the wellbore. The blades 218 may be upstanding from the downhole end of the bit body 216 and extend outwardly away from the central axis of rotation X. Channels (or waterways or junk slots) 222 extend between the blades 218.

The cutting elements 220 are positioned along the blades 218 for engaging the wellbore wall. The cutting elements 220 may be provided with and/or made of, for example, polycrystalline and/or single crystal diamond grains embedded and/or impregnated to abrade the formation material upon rotation of the drill bit 112*a*.

A cavity 219 extends into the shank 214 and bit body 216 for receiving the fluid therethrough. A passage 221 extends from the cavity 219 through the bit body 216 for passing the fluid therethrough. Self-directing nozzles 101 are positioned within bit body 216 about an outlet of the passage 221 for directing the fluid therethrough. One or more conventional nozzles may also be provided in the drill bit 112*a*.

Emitted fluid may be passed from the nozzles 101 and through the channels 222 to remove cuttings. The nozzles 101 may be used, for example, to allow drilling fluid to be supplied to the channels 222 between the blades 218 for the purposes of cooling and cleaning of the cutting elements 220, and/or to carry material abraded, gouged or otherwise removed from the formation during drilling away from the drill bit 112*a*. As shown, for example, by the curved arrows in FIG. 3, one or more of the self-directing nozzles 101 may be used to provide a movable stream of fluid about the bit 112*a*.

As shown in FIGS. 5-8, the drill bit 112*b* is a roller cone drill bit including a shank 514, a bit body 516, legs 517, cones (or pin sections) 518, teeth 520, and nozzles 101. The drill bit 112*b* (and/or portions thereof) may be made of any suitable material, such as tungsten carbide. The shank 514 is connectable to the downhole tool (see 102 of FIG. 1) and drivable thereby about an axis X as indicated by the curved arrows. The shank 514 may be provided with threads or other means for connection to the downhole tool.

The bit body 516 is supported by the shank 514 and has the legs 517 and cones 518 extending therefrom. The legs 517 may be welded to bit body 516 or welded together to form at least part of the bit body 516. The legs 517 extend below the bit body 516 for supporting the cones 518 thereon. The legs 517 may be shaped to protect the cones 518 (and/or parts thereof) from damage caused by, for example, cuttings entering between leg 517 and its respective cone 518. While three legs 517 with three corresponding cones 518 are provided, any configuration may be used.

The cones 518 are rotationally carried by the legs 517 for engagement with the wall of the well bore. The bit body 516 is rotatable as indicated by the curved arrow. The cones 518 may also be rotatably mounted to the legs 517 via a bearing shaft (or other means). The cones 518 are provided with the teeth 520 for abrading the wellbore wall.

A cavity 519 extends into the shank 514 and bit body 516 for receiving the fluid therethrough. A passage 521 extends from the cavity 519 to define a passage for the fluid to exit through the bit body 516. One or more nozzles 101 may be positioned in the passage 521 for directing the flow of the fluid from passage 521. Self-directing nozzles 101 are positioned within bit body 516 about an outlet of the passage 521 for directing the fluid therethrough. One or more conventional nozzles may also be provided in the drill bit 112*b*.

Emitted fluid may be passed from the nozzles 101 and about the cones 518 to remove cuttings. The nozzles 101 may be used, for example, to allow drilling fluid to be supplied about the legs 517 and/or cones 518 for the purposes of cooling and cleaning of the cones 518, and/or to carry material abraded, gouged or otherwise removed from the formation during drilling away from the drill bit 112*b*. As shown, for example, by the curved arrows in FIG. 6, the self-directing nozzles 101 may be used to provide a movable stream of fluid about the bit 112*b*.

The drill bits 112*a,b* may be provided with various features and/or options. For example, lubricant reservoirs (not shown) may be provided to lubricate portions of the bit, such as bearings and/or cones 518. In another example, the drill bits 112*a,b* may have a predetermined gauge (or diameter), defined by an outermost reach of the bit body 216, 516, the blades 218, and/or the rolling cone cutters 518. The self-directing nozzles 101 may have a specific orientation and/or configuration to steer the fluid in a desired direction about the drill bit 112*a,b*. As described herein, the nozzles 101 may have movable parts to enable movement of the self-directing nozzles 101 to vary direction of the fluid flow therefrom.

The nozzles in the drill bit 112*a,b* may also have a specific orientation and/or configuration to steer the fluid in a desired direction about the drill bit 112*a,b* and/or portions of the well bore. One or more of the nozzles may be conventional nozzles that provide a stationary stream of fluid. One or more of the self-directing nozzles 101 may have movable parts to enable movement of the self-directing nozzles 101 to provide a movable stream of fluid and/or to vary direction of the fluid flow therefrom.

While FIGS. 2-8 show example configurations of drill bits with nozzles, it will be appreciated that a variety of other drill bits (and/or other downhole tools) of various materials may be used.

Exemplary Nozzle Structures

Figure 13:
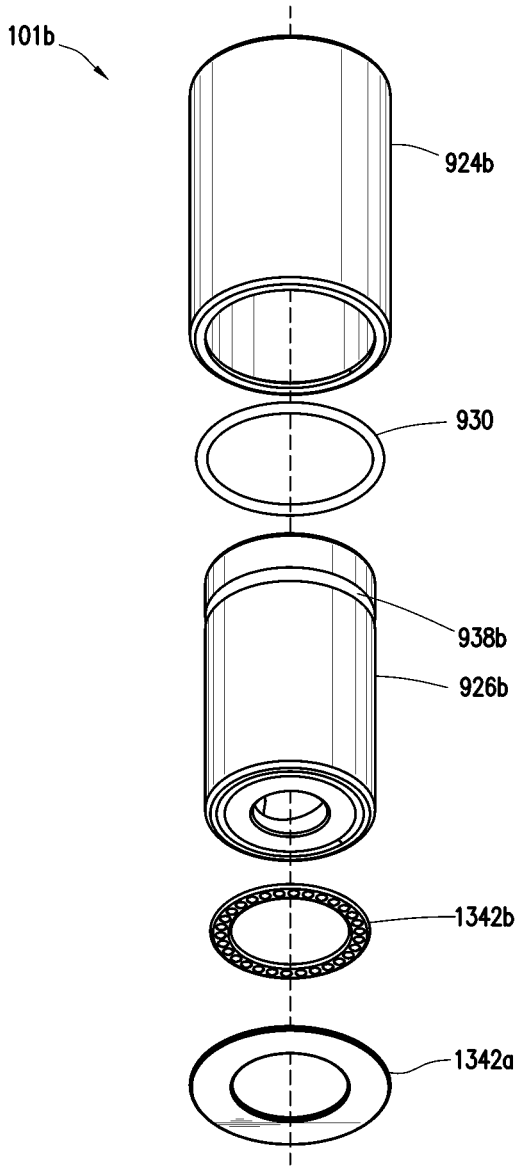
FIG. 13 is an exploded view of another self-directing nozzle in a retention bearing configuration without threads.
Figure 14:
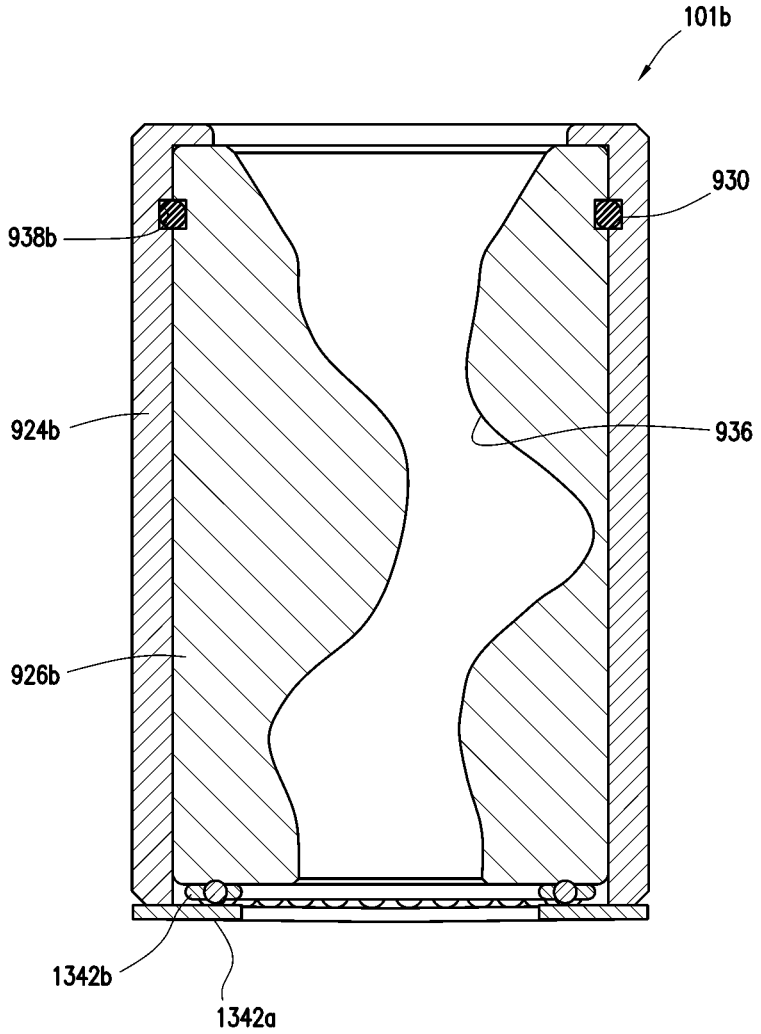
FIG. 14 is a longitudinal cross-sectional view of the self-directing nozzle of FIG. 13.
Figure 15:
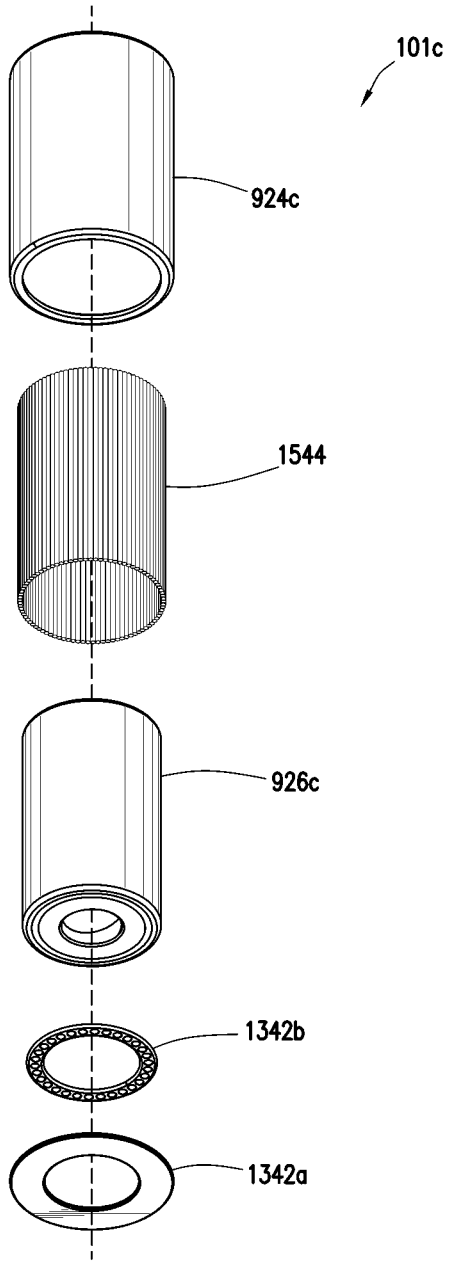
FIG. 15 is an exploded view of yet another self-directing nozzle in a thrust bearing configuration.
Figure 16:
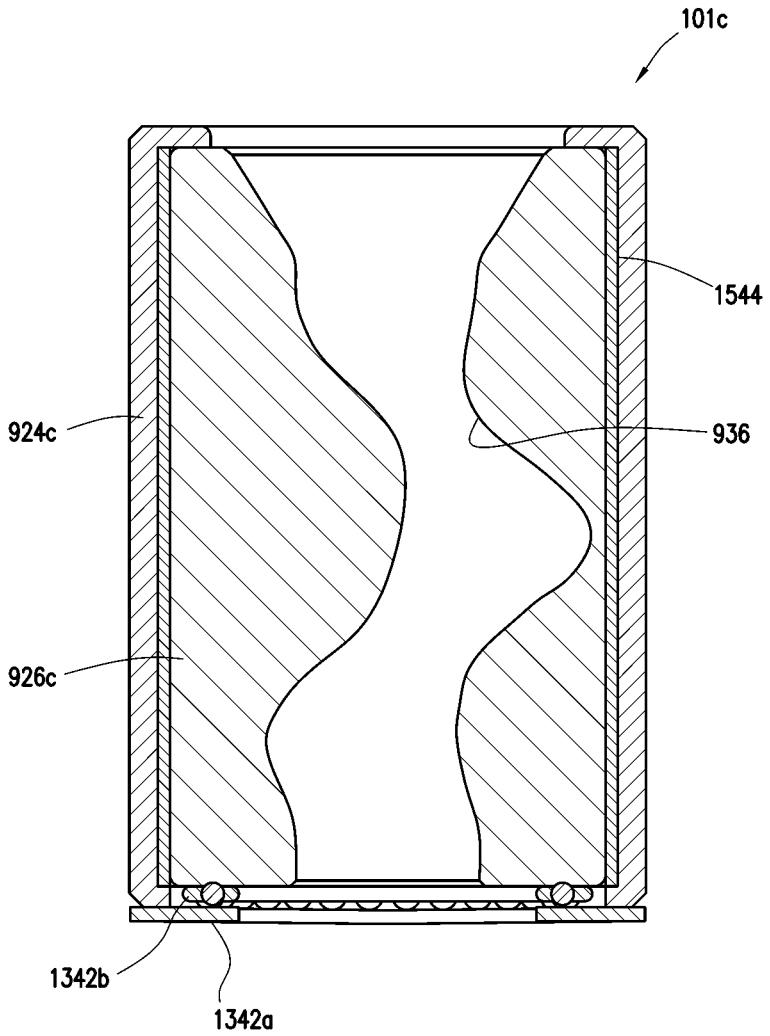
FIG. 16 is a longitudinal cross-sectional view of the self-directing nozzle of FIG. 15.

FIGS. 9-16 provide various views of example self-directing nozzles usable in the drill bits for directing fluid flow therethrough. FIGS. 9-12 depict a self-directing nozzle 101*a* in a retention bearing configuration with threads. FIGS. 13-14 depict a self-directing nozzle 101*b* in a retention bearing configuration without threads. FIGS. 15-16 depict a self-directing nozzle 101*c* in a thrust bearing configuration.

The self-directing nozzle 101*a* of FIGS. 9-12 includes a cage 924*a*, a movable body 926*a*, bearing 928, and seal 930. The cage 924*a* is receivable in a flow area of a drill bit (e.g., passage 521 of drill bit 112*b* of FIGS. 5-8). As shown, the cage 924*a* has a tubular shape with threads 932 thereon matably connectable to threads along passage (e.g., 521 of FIG. 7) of the drill bit. The cage 924*a* also has raised teeth 934 at an end thereof to facilitate insertion/retrieval about the drill bit.

The movable body 926*a* is a cylindrical member receivable within the cage 924*a*. The cage 924*a* and the movable body 926*a* have grooves 938*a,b* therein. The grooves 938*a,b* may be circular grooves extending into an outer surface of the movable body 926*a* and an inner surface of the cage 924*a*. The groove 938*a* may be a bearing groove to receive the bearing 928 therein. The groove 938*b* may be a seal groove to receive the seal 930 therein.

The bearing 928 may be, for example, a retention bearing to retain the movable body 926*a* in the cage 924*a* while permitting movement (e.g., rotation about axis X in FIG. 11A, 11B) of the movable body 926*a*. The seal 930 may be, for example, a gasket, washer, o-ring, and/or other sealing means capable of preventing fluid flow therebetween. The bearing 928 and the seal 930 may be positioned in the grooves 938*a,b* between the movable body 926*a* and the cage 924*a* to permit rotation of the movable body 926*a* relative to the cage 924*a*.

The movable body 926*a* has a channel 936 for the passage of fluid therethrough. The rotation of the movable body 926*a* may also be manipulated to steer flow through the channel 936. The rotation of the movable body 926*a* may be driven by fluid flow through the channel 936. The channel 936 may be shaped to facilitate flow therethrough, and/or to create momentum to rotate the movable body 926*a* under drilling conditions. The shape of the channel 936 may be selected, for example, such that drilling fluid flows through the channel 936 causing the movable body 926 to rotate about axis X to provide a circulating negative pressure over at least a portion of a surface of the wall of the wellbore as described further herein. A zone of negative pressure, as used herein, refers to a zone where dynamic or fluctuating pressure is higher than the mean or static pressure generated by a jet. The mean or static pressure is in addition to the wellbore hydrostatic pressure. Thus, in a zone of negative pressure, the pressure fluctuates between a value below the hydrostatic pressure and a value above the hydrostatic pressure. The pressure may remain above the hydrostatic pressure outside of the zone of negative pressure.

Figure 11A:
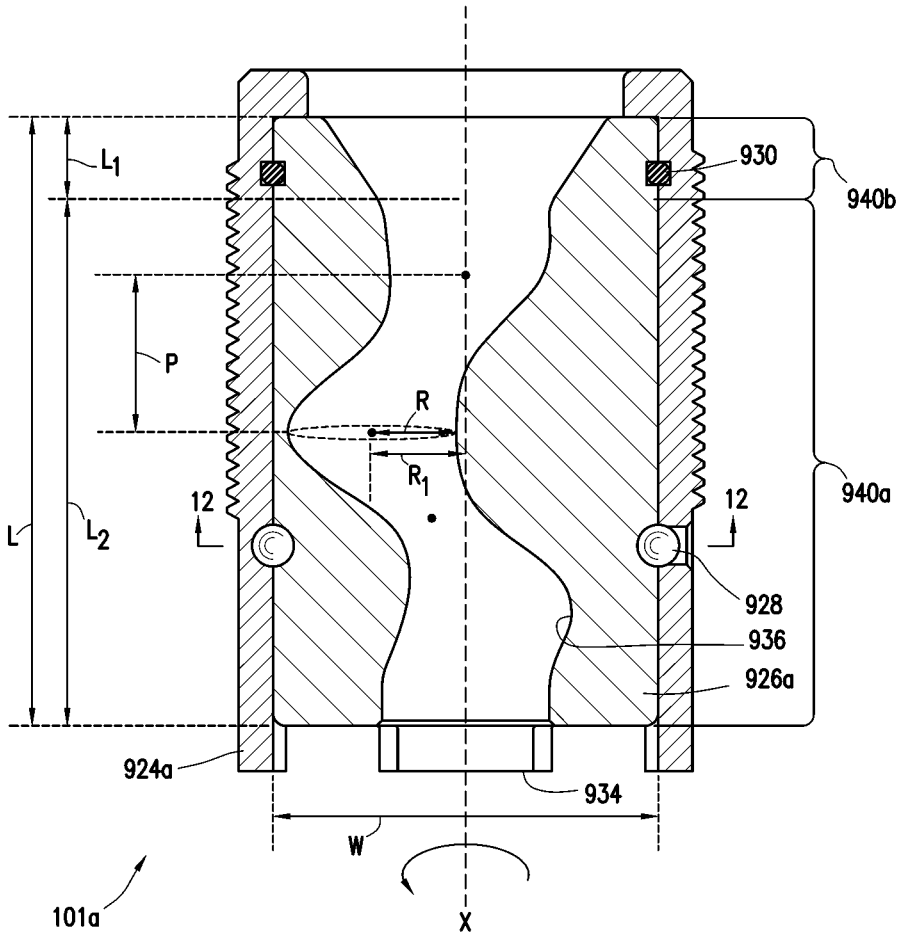
FIGS. 11A-11B are longitudinal, cross-sectional views of the self-directing nozzle of FIG. 9 taken along line 11-11.
Figure 11B:
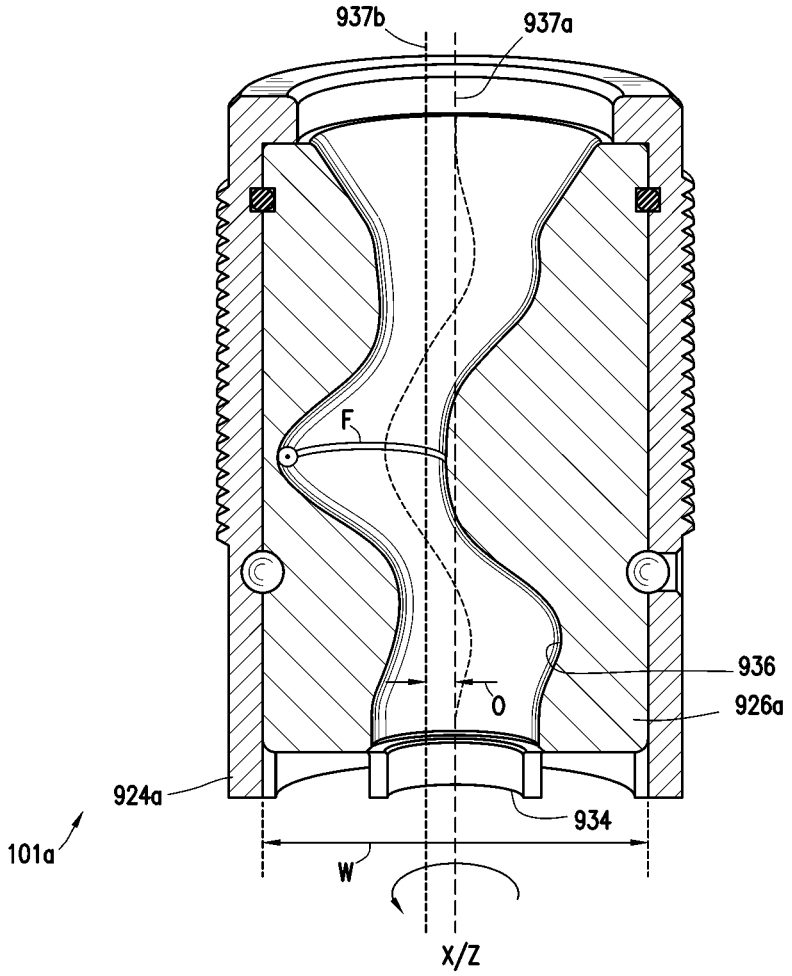
Figure 12:
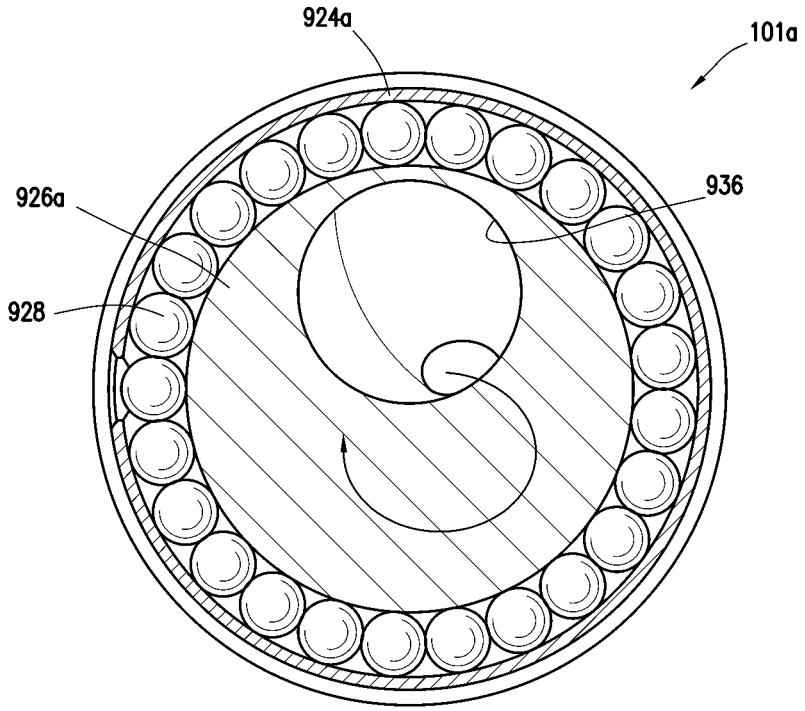
FIG. 12 is a radial cross-sectional view of the self-directing nozzle of FIG. 11A taken along line 12-12.

FIGS. 11A-11C show various views of the self-directing nozzle 101*a* depicting dimensions, shape, and flow relating thereto. As shown in FIG. 11A, the channel 936 has a non-linear configuration including an inlet portion 940*b* and a flow portion 940*a*. The channel 936 is curved in a helical shape extending through the movable body 926*a*. 'Non-linear' as used herein refers to a shape having linear and/or curved portions that provides a change in direction of flow as it passes through the channel 936, and/or that provides for a movement of a stream of fluid as the movable body 926*a* is moved about the cage 924*a* and/or the drill bit.

The channel 936 may have linear and/or curved portions in an overall non-linear configuration. The non-linear channel may be, for example, 'helical' (e.g., a conic helix, a circular helix, (i.e. one with constant radius) a cylindrical helix (i.e., one where its tangent makes a constant angle with a fixed line in space), a general helix (i.e., one where the ratio of curvature to torsion is constant), a slant helix (i.e., one whose principal normal makes a constant angle with a fixed line in space), spiral, etc.), variations of helix (e.g., with linear portions replacing curved portions along a helix), bent, stepped, and/or other shapes.

The dimensions of the non-linear channel 936 may be selected to provide desired operation. Such dimensions may include, for example, a length L of the movable body 926*a*, a length L1 of an inlet portion 940*b* of the channel 936, and a length L2 of a flow portion 940*a* of the channel 936, and have a width W of movable body 926*a*. A pitch P is defined between peaks (farthest radial points) of along the channel 936. The non-linear channel 936 may have a constant or variable channel radius R defining the space for fluid flow therethrough. The channel radius R as shown in FIG. 11 has the tapered inlet portion 940*b* at one (top) end thereof, and is constant from the tapered inlet to an opposite outlet (bottom) end of the movable body 926*a*. The non-linear channel 936 may also have a constant or variable curve radius R1 defining the distance from the X axis to a center of the channel radius R at its peak (farthest radial point).

Referring to FIG. 11B, the non-linear channel 936 has a central line 937*a* extending therethrough. This central line 937*a* is centrally positioned within the non-linear channel 936 along the length L of the non-linear channel 936. This central line 937*a* is a center of the non-linear channel and passes through a center of the radiuses along the length L. Alternatively, the non-linear channel 936 may have a different offset center line 937*b* extending therethrough. The center line 937*b* is a linear axis parallel to the central line 937*a* of the non-linear channel 936. This center line 937*b* is parallel to the central axis Z of the nozzle 101*a*, and axially offset a distance O therefrom. This distance O may be increased to create a greater offset to magnify the amount of force generated by flow of fluid therethrough and increases rotational speed of the body 926*a*. The central axis Z as shown is co-linear with the axis X of rotation of the body 926*a*, but optionally may be offset therefrom.

The non-linear channel 936 is curved such that fluid flowing through the non-linear channel 936 creates a tangential unbalanced force against the body 926*a* along the non-linear channel. As also shown by this example, a tangential force F is directed towards an outer surface of the non-linear channel and is directed away from an inner surface of the non-linear channel in a direction normal to the axis X/Z and tangent to the outer surface. The flow generated by the shape of the non-linear channel also provides defines a spiraling fluid path P that also generates momentum to facilitate rotation of the body 926*a*.

While the nozzles herein are provided with a specific shape, it will be appreciated that various shapes may be provided to achieve the axially offset, non-linear shape that may be used to facilitate rotation of the body within the cage.

FIGS. 13-14 show another version of the self-directing nozzle 101*b*. This version is similar to the self-directing nozzle 101*a* of FIGS. 9-12, except with a different cage 924*b*, movable body 926*b*, and additional rings 1342*a,b*. In this version, the cage 924*b* has no threads or teeth (e.g., 932, 934 of FIG. 9). The cage 924*b* may be press fit or otherwise fixed within the drill bit (e.g., about passage 521 of FIG. 7). The movable body 926*b* has the seal groove 938*b*, but no bearing groove (e.g., 938*a* of FIG. 9).

Rings 1342*a,b* are disposed about an end of the self-directing nozzle 101*b*. Outer ring 1342*a* is positioned adjacent an end of the cage 924*b* and inner ring 1342*b* is positioned between the outer ring 1342*a* and the movable body 926*b*. As shown, the ring 1342*a* may be a donut shaped plate and the ring 1342*b* may be a bearing (e.g., thrust bearing). Also, this view shows channel 936 in a different orientation.

FIGS. 15-16 show another version of the self-directing nozzle 101*c*. This version is similar to the self-directing nozzle 101*b* of FIGS. 13-14, except with a different cage 924*c* and movable body 926*c* without the grooves, seal, or thrust bearing of FIGS. 9-14, and with a journal bearing 1544. As shown, the journal bearing 1544 is a tubular member disposed between movable body 926*c* and cage 924*c*. The journal bearing 1544 may have axial ridges on an outer surface thereof.

Figure 17:
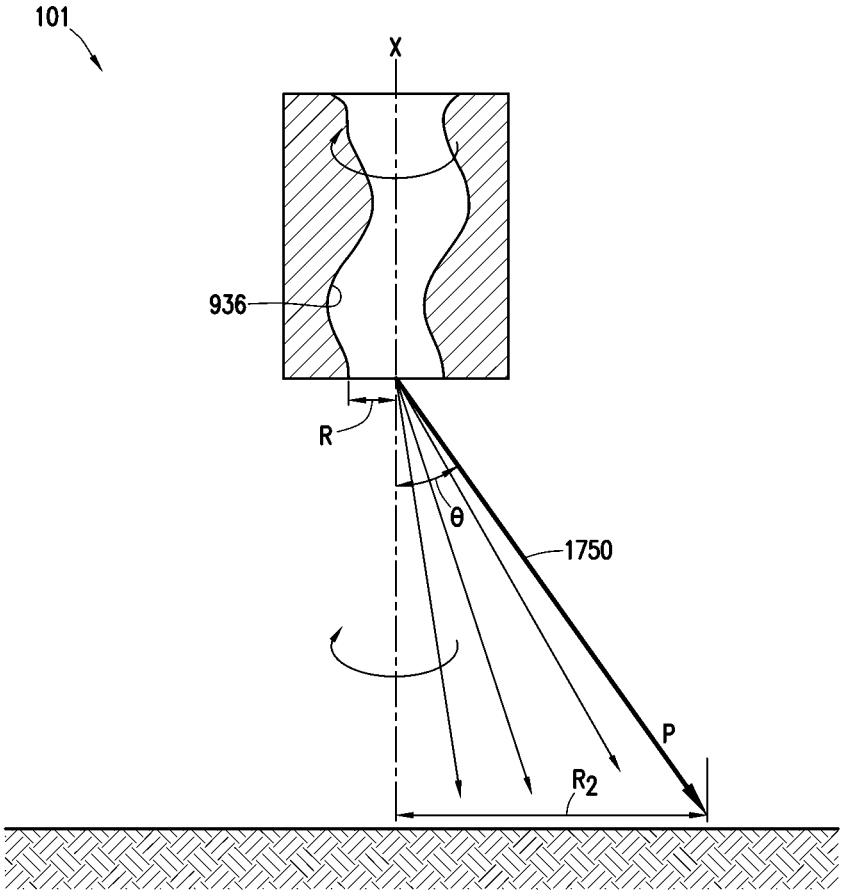
FIG. 17 is a schematic diagram depicting flow through the self-directing nozzle.
Figure 18:
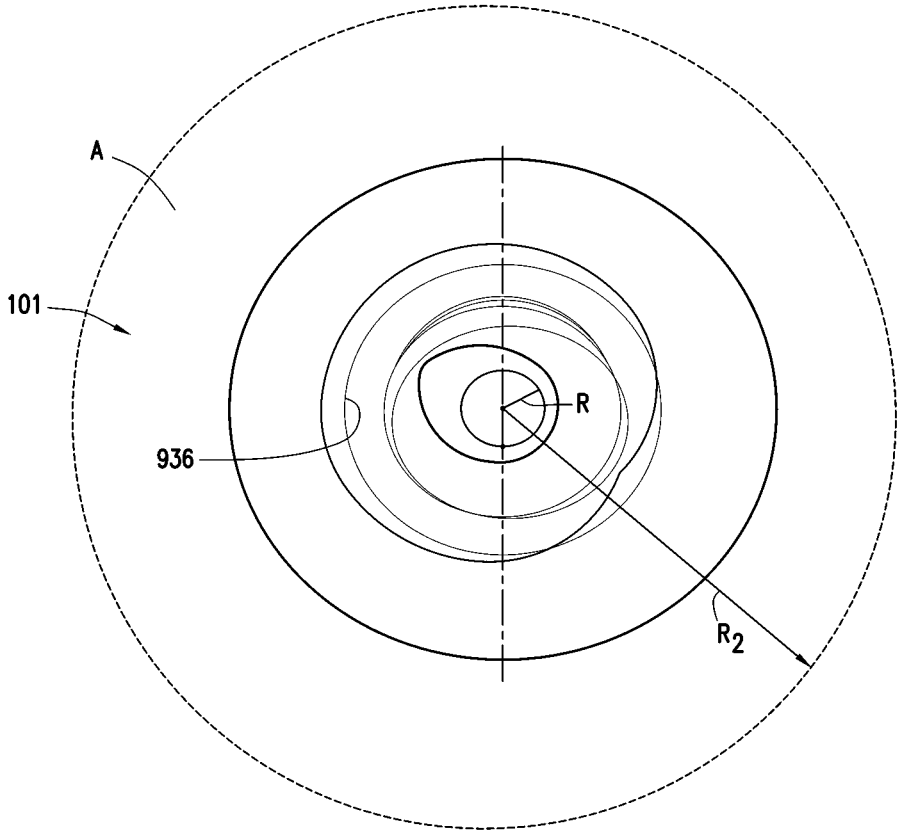
FIG. 18 is a schematic diagram depicting dimensions about an end of the nozzle.
Figure 19:
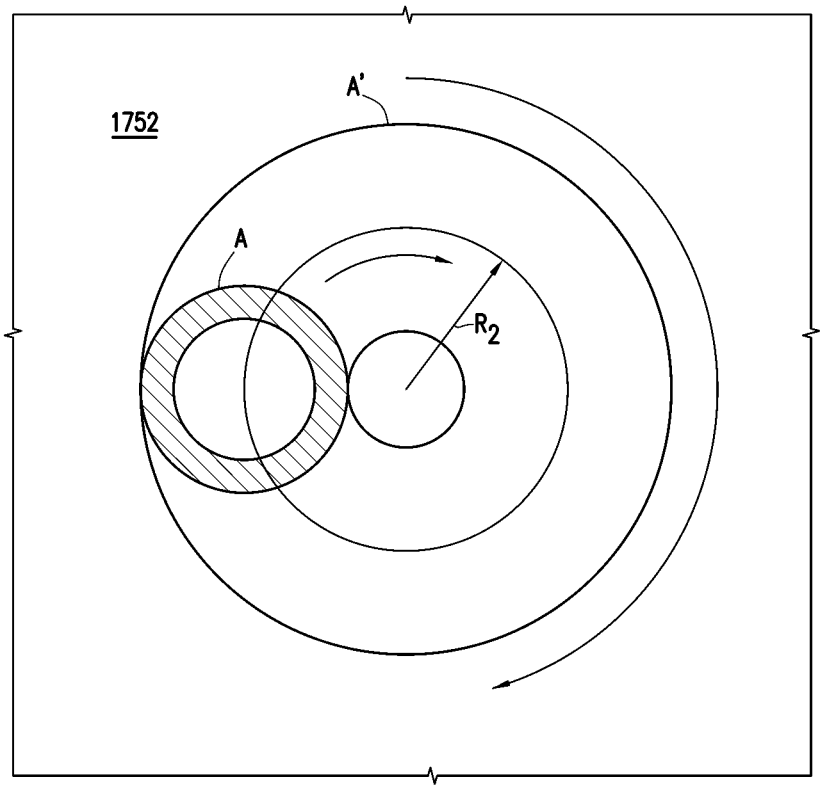
FIG. 19 is a schematic diagram depicting a flow path of the self-directing nozzle.

FIGS. 17-20 depict flow from a self-directing nozzle 101 with channel 936, which may represent any of the self-directing nozzles and/or channels described herein. FIG. 17 shows a longitudinal cross-sectional view of the self-directing nozzle 101 with the channel 936 emitting fluid therefrom onto a wellbore surface 1752. FIG. 18 shows an end view of the self-directing nozzle 101 depicting dimensions thereabout. FIG. 19 shows a schematic view of the wellbore surface 1752 depicting movement of the self-directing nozzle 101 thereabout.

FIG. 17 shows the same channel 936 depicted in FIGS. 9-20, except with portions of the movable body removed to show flow through the channel 936. In operation, drilling fluid exits nozzle 101 having a radius R in fluid flow direction 1750 forming an angle θ from axis X. The fluid flow direction 1750 as defined by the angle θ, forms a rotation radius R2 on a wellbore surface 1752. The distance of the flow and the direction 1750 of angle θ define a surface area A along wellbore surface 1752. Output from the nozzle 101 as it rotates defines a cone of fluid flow applied to the surface 1752 of the wellbore. A high negative circulating pressure P is applied to the surface area A defined along wellbore surface 1752.

While FIGS. 1-16 show example configurations of a drill bit and nozzle, variations are possible. For example, various combinations of the features provided may be provided. Also, while the figures here may indicate a certain rotation and/or movement, other directions of rotation and/or other movements may be possible. For example, while the curved arrow shows a counter clockwise rotation of the self-directing nozzles 101 in the embodiment of FIG. 3, the self-directing nozzles 101 are not restricted to provide a counter clockwise rotation.

FIGS. 18-19 schematically depict a projection onto wellbore surface 1752 of an area A of circulating negative pressure generated by fluid flow through the self-directing nozzle 101. As the self-directing nozzle 101 rotates due to the flow of drilling fluid therethrough, area A circulates on the radius R2, forming a total area A'. The self-directing nozzle 101 may be used, for example, to increase a radius R2 of turbulent fluctuation by rotating the self-directing nozzle 101 the direction 8 about the surface 1752. As the area A rotates about radius R2, the fluid stream rotates about a radius R2. This radius R2 may be used to increase the surface area A along surface 1752 to the extended area A', thereby affecting a high difference of dynamic and impingement pressure to facilitate removal of the cuttings.

Figure 20:
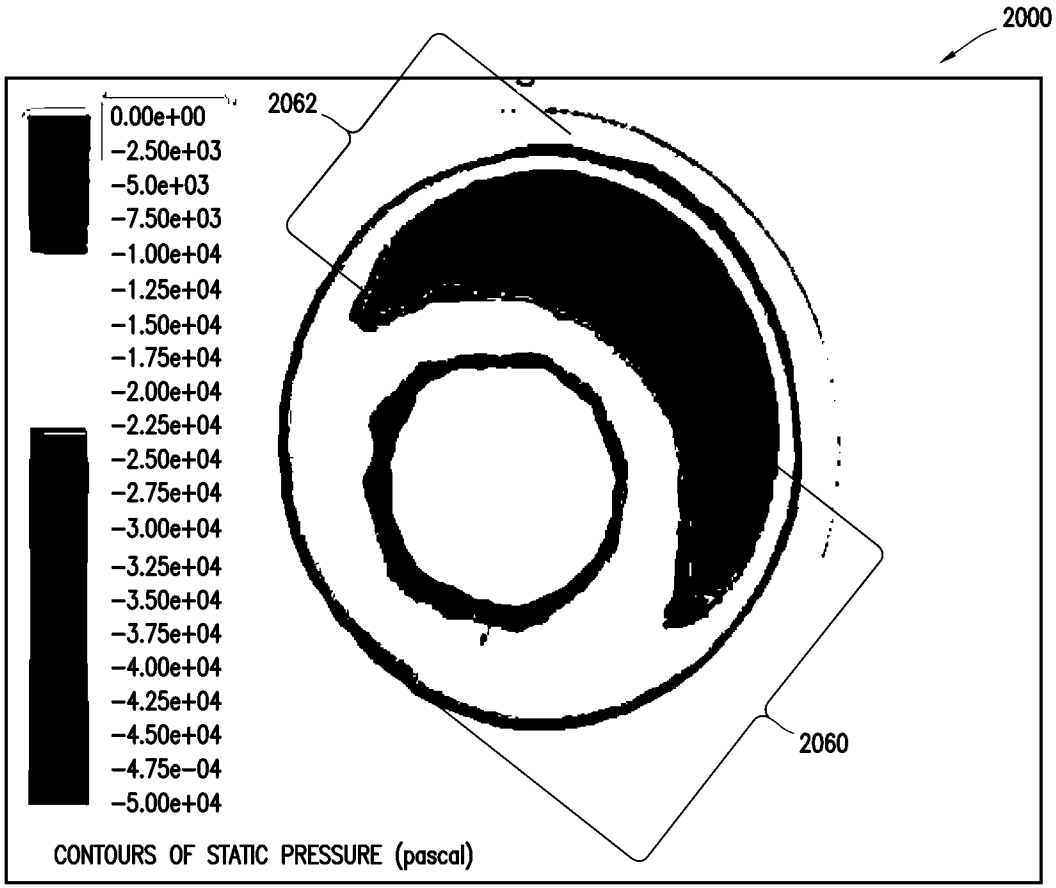
FIG. 20 is a graph depicting pressure generated by the self-directing nozzle.

Fluid dynamics and/or turbulent fluctuation generated about the nozzle 101 may be used to provide a high pressure differential ΔP about the surface area A. FIG. 20 is a graph 2000 depicting a simulation of calculated instantaneous pressures at the surface 1752 (FIGS. 17-19) using the self-directing nozzle. This figure demonstrates the large area of negative pressure 2060 produced by the self-directing nozzle about radius R, and an area of positive pressure 2062 generated adjacent to the area 2060. In a negative pressure zone, turbulent pressure fluctuations on the surface of the wellbore may provide transient pressure levels that are lower than the wellbore hydrostatic pressure, and sometimes lower than the formation pressure level. These low pressure levels may facilitate removal of cuttings from the bottom of the wellbore in that region.

Figure 21:
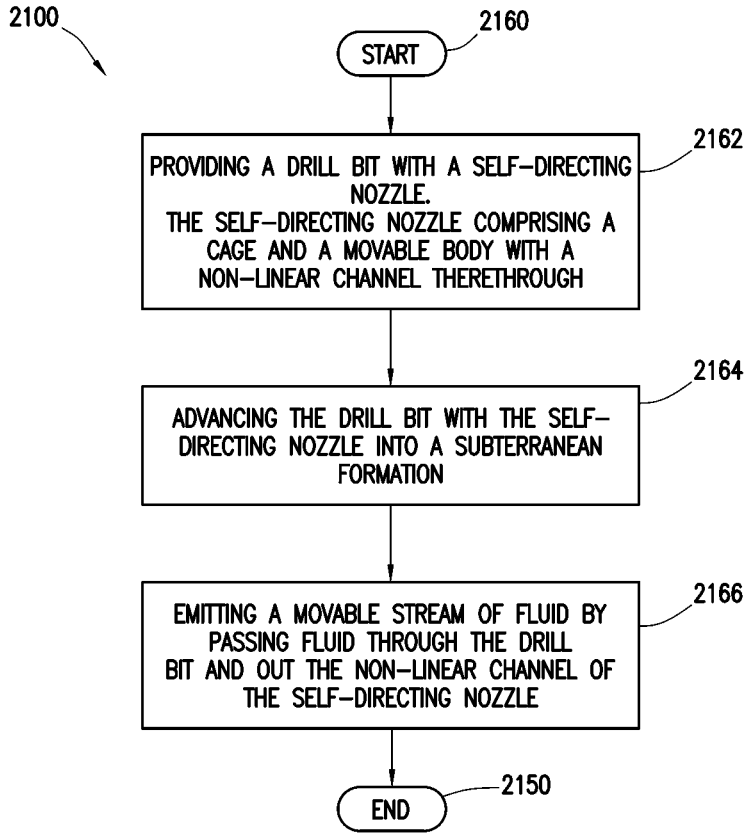
FIG. 21 is a flow chart depicting a method of drilling a wellbore.

FIG. 21 is a flow chart depicting a method 2100 of drilling a wellbore. The method 2100 begins at start 2160. Start 2160 may include any procedure prior to subsequent procedures, such as assembly, deployment and operation of part or all of the well site, drilling tool, and/or drill bit (see, e.g., FIG. 1). The method 2100 involves providing 2162 a drill bit with a self-directing nozzle comprising a cage and a movable body with a non-linear channel therethrough. The method 2100 continues by advancing 2164 the drill bit with the self-directing nozzle into a subterranean formation, and emitting 2166 a movable stream of fluid by passing fluid through the drill bit and out the non-linear channel of the self-directing nozzle. The emitting 2166 may involve passing fluid through the drill bit and through the axially offset, non-linear channel such that the fluid rotates the movable body within the passage of the drill bit to emit a movable stream of fluid about the drill bit.

The method 2100 may also involve other features, such as applying pressure to a surface of the wellbore, cleaning the wellbore with the stream of fluid, pumping fluid through a drilling tool and out the drill bit, pumping the emitted fluid back to the surface, etc. The method 2100 ends at 2150. The method may be performed in any order and repeated as desired.

Although a few example embodiments have been described in detail above, those skilled in the art will readily appreciate that many modifications are possible in the example embodiments without materially departing from this disclosure. Accordingly, such modifications are intended to be included within the scope of this disclosure as defined in the following claims. In the claims, means-plus-function clauses are intended to cover the structures described herein as performing the recited function and not simply structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and/or other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

The above description is illustrative of the preferred embodiment and many modifications may be made by those skilled in the art without departing from the invention whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations are possible, such as providing one or more self-directing and/or other nozzles, and/or providing self-directing nozzles with a variety of features, such as cages, bodies, seals, bearing, rings, and/or other features. Also, various combinations of the features herein may be provided in one or more cutting elements and/or drill bits.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

All documents described herein are incorporated by reference herein, including any priority documents and/or testing procedures to the extent they are not inconsistent with this text, provided however that any priority document not named in the initially filed application or filing documents is NOT incorporated by reference herein. As is apparent from the foregoing general description and the specific embodiments, while forms of the invention have been illustrated and described, various modifications can be made without departing from the spirit and scope of the invention. Accordingly, it is not intended that the invention be limited thereby. Likewise, the term "comprising" is considered synonymous with the term "including" for purposes of Australian law. Likewise whenever a composition, an element or a group of elements is preceded with the transitional phrase "comprising", it is understood that we also contemplate the same composition or group of elements with transitional phrases "consisting essentially of," "consisting of", "selected from the group of consisting of," or "is" preceding the recitation of the composition, element, or elements and vice versa.

What is claimed is:

1. A self-directing nozzle of a drill bit of a downhole tool for forming a wellbore in a subterranean formation, the drill bit having a passage for fluid to pass through, the nozzle comprising:

a cage positionable in the passage of the drill bit; and a movable body movably positionable in the cage, the movable body having not more than one channel for passage of the fluid therethrough, the channel having a non-linear shape with a channel center line extending therethrough, the channel being curved to define a spiral flow path therethrough whereby the fluid passing through the channel facilitates rotation of the movable body within the passage of the drill bit.

2. The nozzle of claim 1, further comprising a dynamic seal between the movable body and the cage.

3. The nozzle of claim 1, further comprising a bearing positioned between the movable body and the cage.

4. The nozzle of claim 1, wherein at least one of an outer surface of the movable body and an inner surface of the cage has grooves extending therein.

5. The nozzle of claim 1, wherein the cage has threads engageable with threads of the drill bit.

6. The nozzle of claim 1, wherein the cage has an outer surface engageable with an inner surface of the passage of the drill bit defining a press fit therebetween.

7. The nozzle of claim 1, wherein the cage has teeth extending from an end thereof.

8. The nozzle of claim 1, wherein the channel has a funnel shaped inlet.

9. The nozzle of claim 1, wherein at least a portion of the channel is helical.

10. The nozzle of claim 1, wherein the channel has a circular outlet.

11. The nozzle of claim 1 further comprising a cage axis of rotation, and wherein the channel center line is axially offset from a cage axis of rotation.

12. The nozzle of claim 1, wherein the channel has one of a constant and a variable curved radius along a length thereof.

13. A self-directing nozzle of a drill bit of a downhole tool for forming a wellbore in a subterranean formation, the drill bit having a passage for fluid to pass through, the nozzle comprising:

a cage positionable in the passage of the drill bit, a movable body movably positionable in the cage, the movable body having a channel for passage of the fluid therethrough, the channel having a non-linear shape with a channel center line extending therethrough, the channel being curved to define a spiral flow path therethrough whereby the fluid passing through the channel facilitates rotation of the movable body within the passage of the drill bit, and a bearing positioned between the movable body and the cage.

14. The nozzle of claim 13, further comprising a seal disposed between the movable body and the cage.

15. The nozzle of claim 13, wherein the cage has threads engageable with threads of the drill bit.

16. The nozzle of claim 13, wherein the channel center line is axially offset from a cage axis of rotation.

17. The nozzle of claim 13, wherein the channel has a variable curved radius along a length thereof.

18. A drill bit of a downhole tool for forming a wellbore in a subterranean formation, the drill bit comprising:

a body having a passage for fluid to pass through;

a shank extending from the body and connectable to a drill string of a downhole tool; and a self-directing nozzle, comprising:

a cage having a cage axis of rotation; and a movable body retained within the cage and comprising a channel extending through the movable body, the channel comprising: an inlet and an outlet that is aligned with the inlet along a channel center line, wherein the channel center line is parallel to the cage axis of rotation; and a spiral flow path extending between the inlet and the outlet, whereby the fluid passing through the channel imparts rotation of the movable body about the cage axis of rotation.

19. The drill bit of claim 18, wherein the passage has a cavity portion extending through the shank and into the body, and an outlet portion extending through a wall of the body.

20. The drill bit of claim 18, wherein the channel center line is offset from the cage axis of rotation.

21. The drill bit of claim 20, wherein a plurality of the self-directing nozzles are positioned in passages of the bit body.

22. A method of drilling a wellbore in a subterranean formation, the method comprising:

providing a drill bit with a self-directing nozzle, the self-directing nozzle comprising:

a cage positionable in the passage of the drill bit;

a movable body movably positionable in the cage, the movable body having a channel for passage of fluid therethrough, the channel having a non-linear shape with a channel center line extending therethrough, the channel being curved to define a spiral flow path therethrough; and a bearing positioned between the movable body and the cage;

advancing the drill bit into the subterranean formation; and passing the fluid through the drill bit and through the non-linear channel such that the fluid spirals through the non-linear channel and rotates the movable body within the passage of the drill bit to emit a movable stream of the fluid about the drill bit.

23. The method of claim 22, wherein the passing involves generating a pressure differential about a surface area of the well bore, the surface area having a negative pressure area and a positive pressure area.

24. The method of claim 23, wherein the passing comprises generating transient pressure levels lower than hydrostatic pressure of the wellbore by generating turbulent pressure fluctuations in the negative pressure area on a surface of the wellbore.

25. The method of claim 23, wherein the passing comprises directing a tangential fluid force of the fluid against an exterior surface of the channel.

* * * * *